US009382730B1

(12) United States Patent
Chen et al.

(10) Patent No.: US 9,382,730 B1
(45) Date of Patent: Jul. 5, 2016

(54) LOCKING DEVICE FOR TWO-WAY TRAVEL DRAWER

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKE CO., LTD., Taichung (TW)

( * ) Notice: Subject to any disclaimer, the term of this patent is extended or adjusted under 35 U.S.C. 154(b) by 0 days.

(21) Appl. No.: 14/591,282

(22) Filed: Jan. 7, 2015

(51) Int. Cl.

| | |
|---|---|
| ***E05C 7/06*** | (2006.01) |
| ***E05B 65/46*** | (2006.01) |
| ***A47B 88/04*** | (2006.01) |
| ***A47B 88/16*** | (2006.01) |
| ***A47B 88/02*** | (2006.01) |

(52) U.S. Cl.
CPC ..... *E05B 65/462* (2013.01); *A47B 88/02* (2013.01); *A47B 88/04* (2013.01); *A47B 88/16* (2013.01); *E05B 2065/469* (2013.01)

(58) Field of Classification Search
CPC ..... A47B 88/02; A47B 88/04; A47B 88/16; A47B 2088/0403; E05B 65/462; E05B 2065/469
USPC ..... 312/333, 286, 215–222
See application file for complete search history.

(56) References Cited

U.S. PATENT DOCUMENTS

| | | | | |
|---|---|---|---|---|
| 6,139,034 | A * | 10/2000 | Williams | A47B 31/06 280/47.35 |
| 8,328,246 | B2 * | 12/2012 | Zhang | H05K 5/02 292/137 |
| 8,651,591 | B1 * | 2/2014 | Chen | E05B 65/462 312/218 |
| 8,740,319 | B1 * | 6/2014 | Davis | E05B 65/462 312/216 |
| 8,770,680 | B1 * | 7/2014 | Chen | E05B 65/462 312/221 |
| 8,845,042 | B2 * | 9/2014 | Yang | G06F 1/187 312/222 |
| 2008/0223091 | A1 * | 9/2008 | Kroening | E05B 13/002 70/78 |

* cited by examiner

*Primary Examiner* — Daniel J Troy
*Assistant Examiner* — Ryan A Doyle

(57) ABSTRACT

A locking device for a two-way travel drawer is provided with a peg on one side of each drawer; two two-way travel slides each on an outer surface of either side of the drawer; a groove member including front and rear flanges and a second opening element; a sliding member disposed in the groove member and including a trigger in the second opening element; and snapping members disposed vertically on an inner surface of the sliding member, each snapping member including two end latches secured to the sliding member, an intermediate trough having two vertical sides and a central concave portion interconnecting the vertical sides, two first inclined surfaces each extending from either end latch toward the trough, and two second inclined surfaces each interconnecting the adjacent first inclined surface and the adjacent vertical side.

1 Claim, 12 Drawing Sheets

A-A

B-B

LOCKING DEVICE FOR TWO-WAY TRAVEL DRAWER

BACKGROUND OF THE INVENTION

1. Field of the Invention

The invention relates to drawer slides and more particularly to a locking device for a two-way travel drawer with improved characteristics.

2. Description of Related Art

A drawer is a box shaped container that fits into a piece of furniture (e.g., desk, cabinet, or the like) in such a way that it can be drawn out horizontally to access its contents.

U.S. Pat. No. 8,651,591 B1 entitled "lock device for two way travel drawer" is invented by the present inventors. The '591 patent discloses that a lock device for two-way travel drawers of a support body is provided with in combination a peg on a central portion of one side of the drawer; two two-way travel slides each on an outer surface of either side of the drawer; and a lock assembly including a groove member, a sliding member, a lock, and snapping members. The groove member has a rectangular section and includes front and rear flanges to be secured to a wall of the support body. The sliding member has a rectangular section, is slidably disposed in the groove member, and includes openings. The lock is disposed on an upper portion of the wall of the support body and capable of actuating to activate the sliding member. The snapping members are retained in the openings and capable of locking or unlocking the peg when the sliding member moves.

However, the '591 patent is complicated in terms of structure. Thus, the need for improvement still exists.

U.S. Pat. No. 8,770,680 B1 entitled "lock device for two way travel drawer" is invented by the present inventors. The '680 patent discloses that a lock device for two-way travel drawers of a support body, including in combination pegs each on one side of the drawer; a plurality of two slides each on either side of the drawer; and a lock assembly longitudinally mounted on one side of the support body and including a groove member, a sliding member, a biasing member, a lock, and snapping members. The groove member includes front and rear flanges, and an upward bend on an upper portion. The sliding member is slidably disposed in the groove member and includes longitudinal sets of two flush openings, and an upper hook. The biasing member interconnects the bend and the hook. The lock is on an upper portion of the support body for stopping the sliding member. The snapping member includes a central bottom trough and two inclined surfaces each extending from the trough to either end latch.

However, the '680 patent has the following drawbacks: The positioning of the sliding member in the groove member is not reliable if a pushing force of the drawer is excessive. Further, the piece of furniture (e.g., cabinet) may fall when opening or closing due to imbalance of articles (e.g., hand tools, electric powered tools, etc.) stored in different drawers. Furthermore, the articles fallen out of the cabinet may hurt people besides. Thus, the need for improvement still exists.

Notwithstanding the prior art, the invention is neither taught nor rendered obvious thereby.

SUMMARY OF THE INVENTION

It is therefore one object of the invention to provide a locking device for a plurality of two-way travel drawers of a support body having a top board, a bottom board, and two opposite sides wherein one side has a first opening element, comprising in combination a peg disposed on one side of each of the two-way travel drawers; two two-way travel slides each disposed on an outer surface of either side of each of the two-way travel drawers; a groove member having a rectangular section and including front and rear flanges and a second opening element; a sliding member having a rectangular section and slidably disposed in the groove member, the sliding member including a horizontal trigger moveably disposed in the second opening element; and a plurality of snapping members disposed vertically on an inner surface of the sliding member, each of the snapping members including two end latches secured to the sliding member, an intermediate trough having two vertical sides and a central concave portion interconnecting the vertical sides, two first inclined surfaces each extending from either end latch toward the trough, and two second inclined surfaces each interconnecting the adjacent first inclined surface and the adjacent vertical side; wherein each of the two-way travel drawers is held in place when the peg is disposed in the trough; wherein in response to pushing the trigger upward, both the sliding member and the snapping member move upward so that the peg clears the trough to allow a free movement of each of the two-way travel drawers; and wherein in case of one two-way travel drawer being not pushed into position, a pushing of one two-way travel drawer rides the peg along the first and second inclined surfaces with both the snapping member and the sliding member moving upward, the upward movement stops when the peg is disposed directly below the trough, and both the snapping member and the sliding member move downward to dispose the peg in the central concave portion of the trough by passing the vertical sides.

The above and other objects, features and advantages of the invention will become apparent from the following detailed description taken with the accompanying drawings.

DETAILED DESCRIPTION OF THE INVENTION

Figure 1:
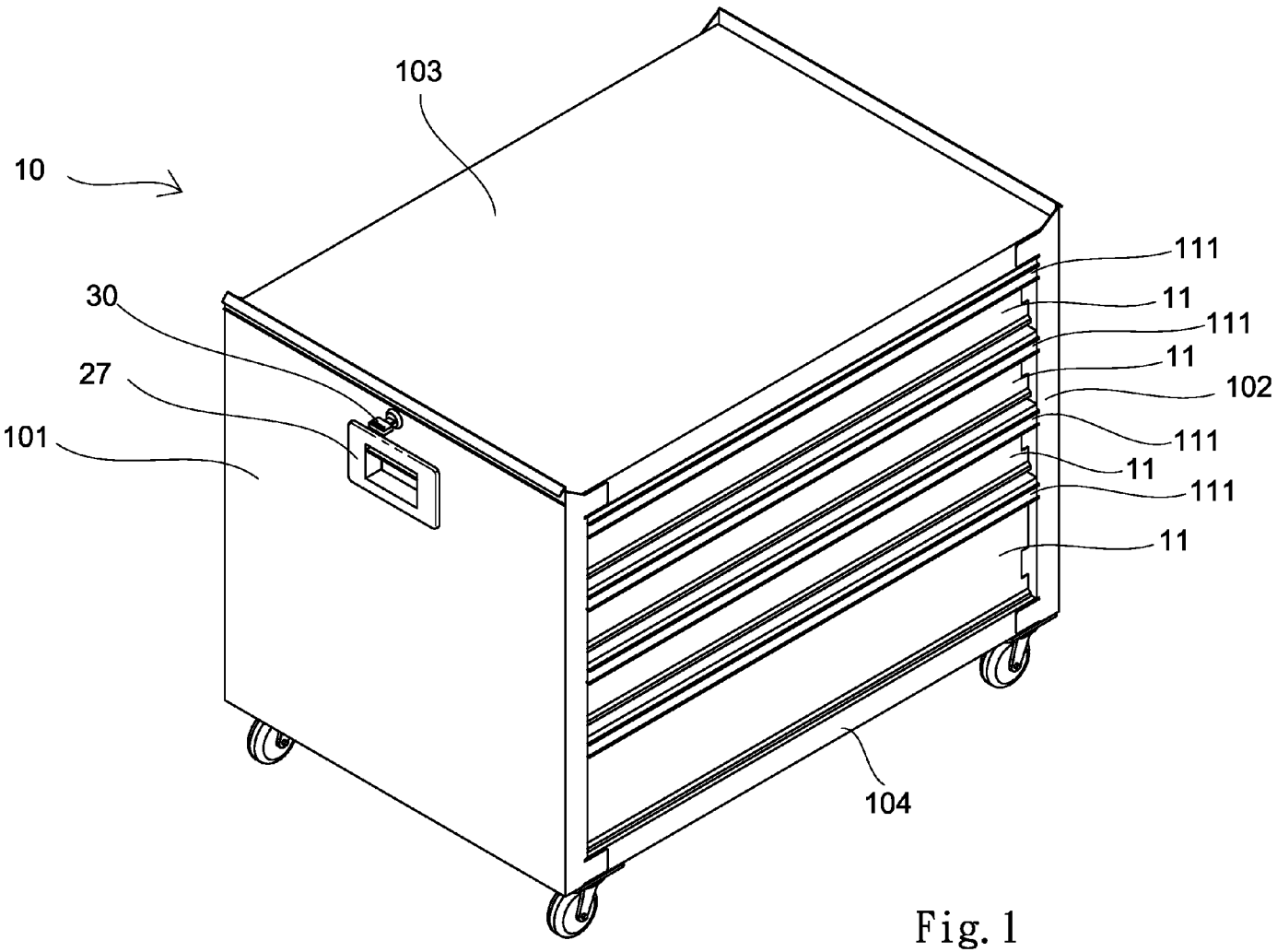
FIG. 1 is a perspective view of a cabinet incorporating a locking device for two-way travel drawers of the cabinet according to the invention.
Figure 2:
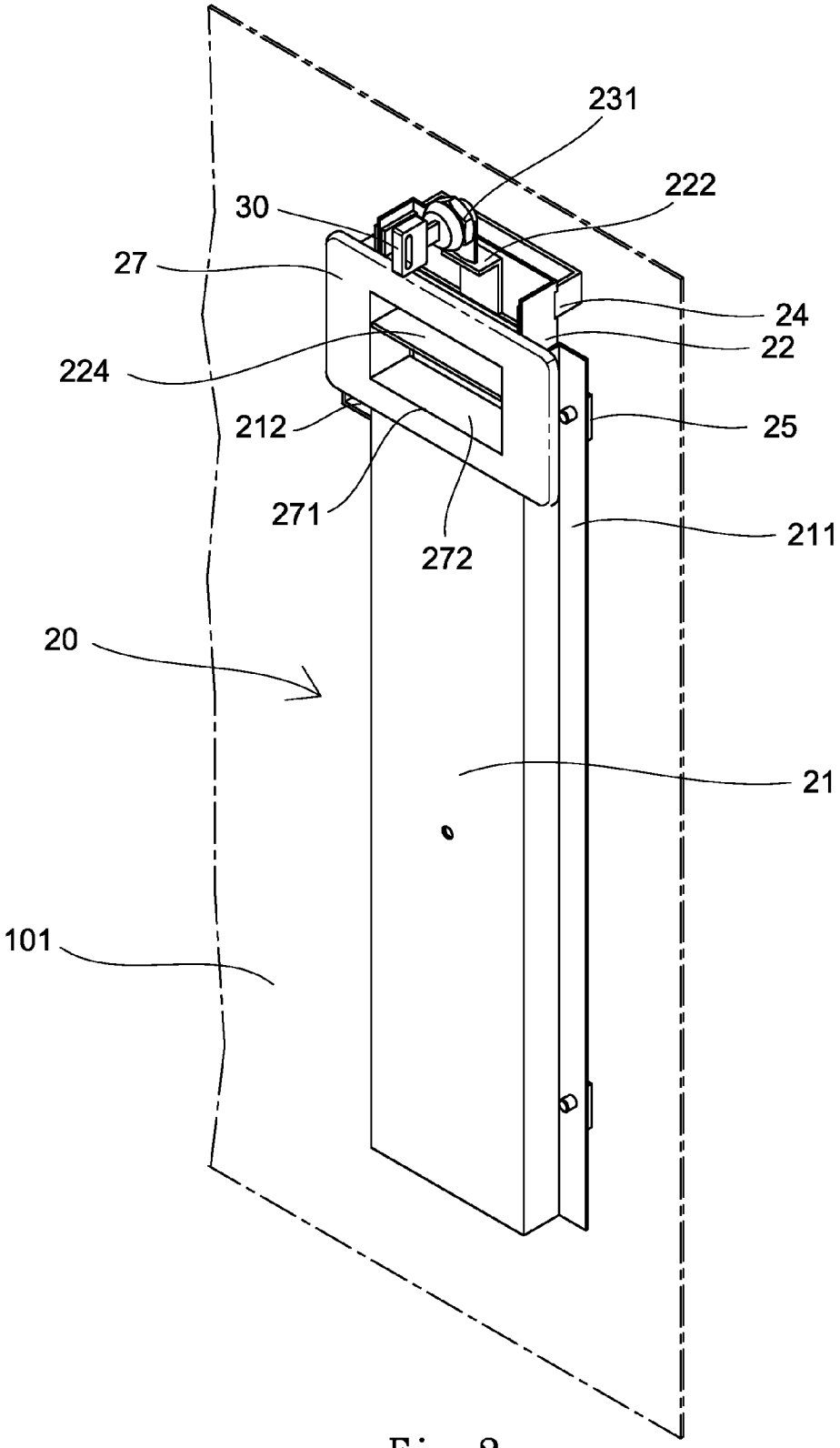
FIG. 2 schematically depicts the locking device and adjacent components.
Figure 3:
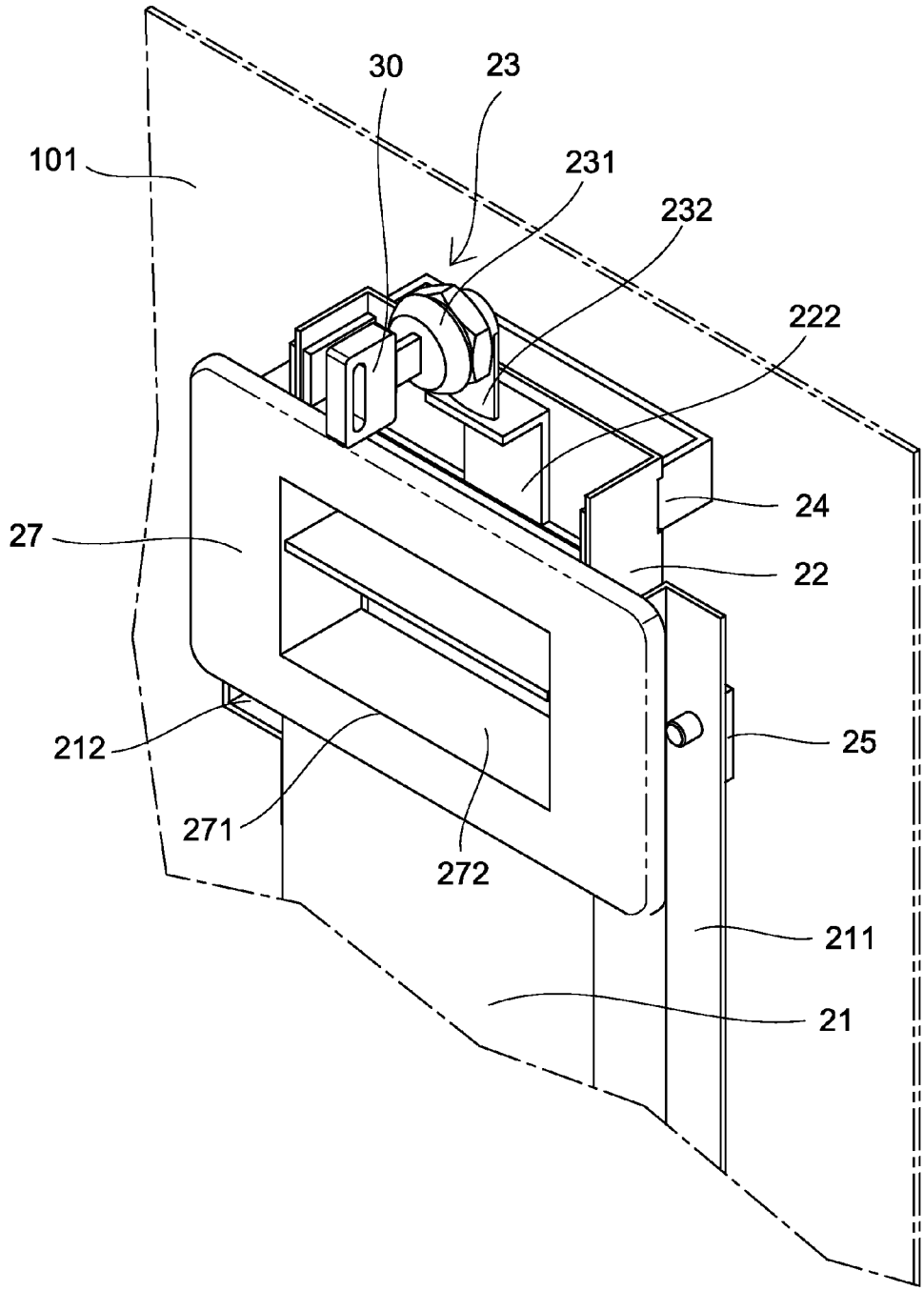
FIG. 3 is an enlarged view of the upper portion of FIG. 2.
Figure 4:
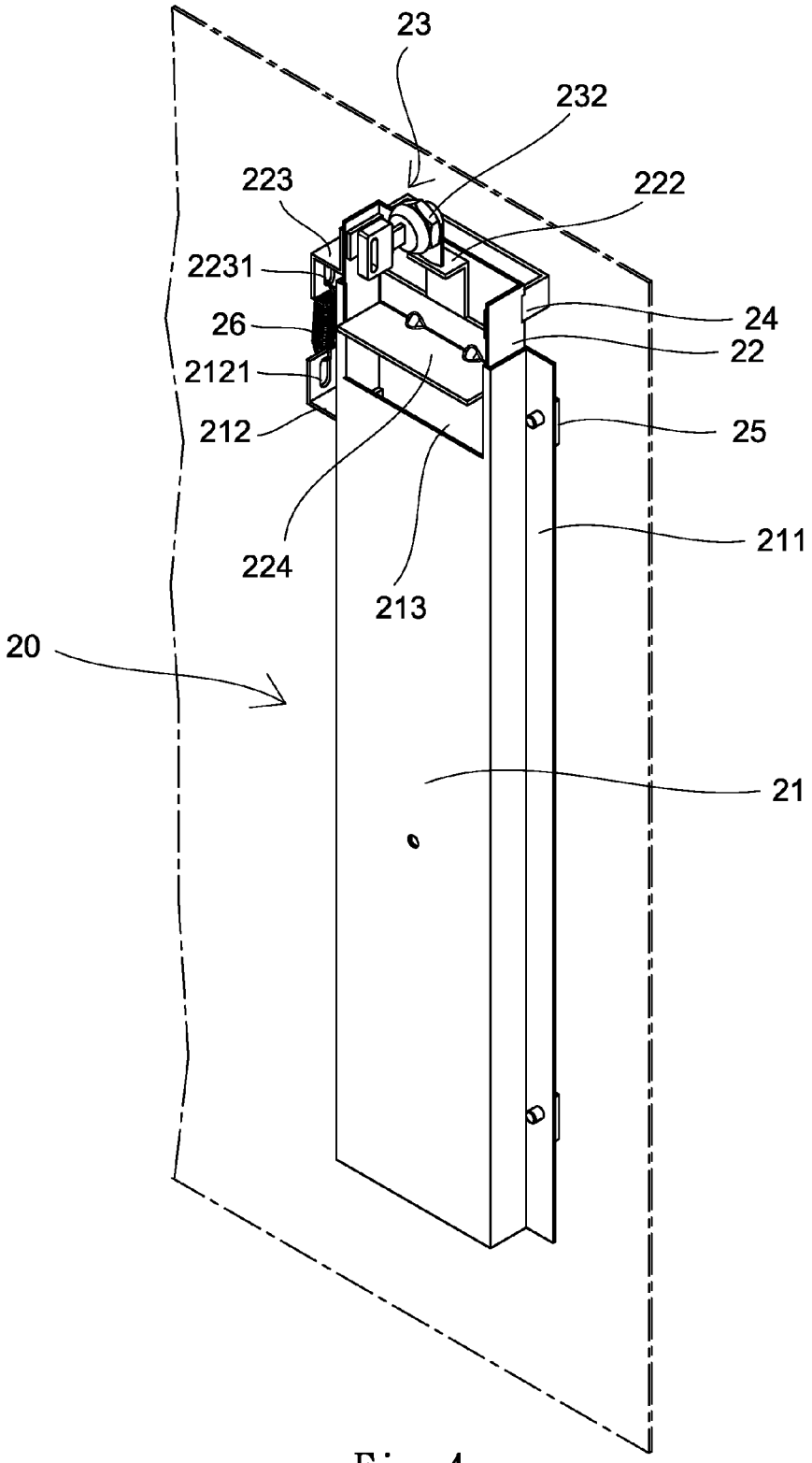
FIG. 4 is a view similar to FIG. 2 with the cover removed.
Figure 5:
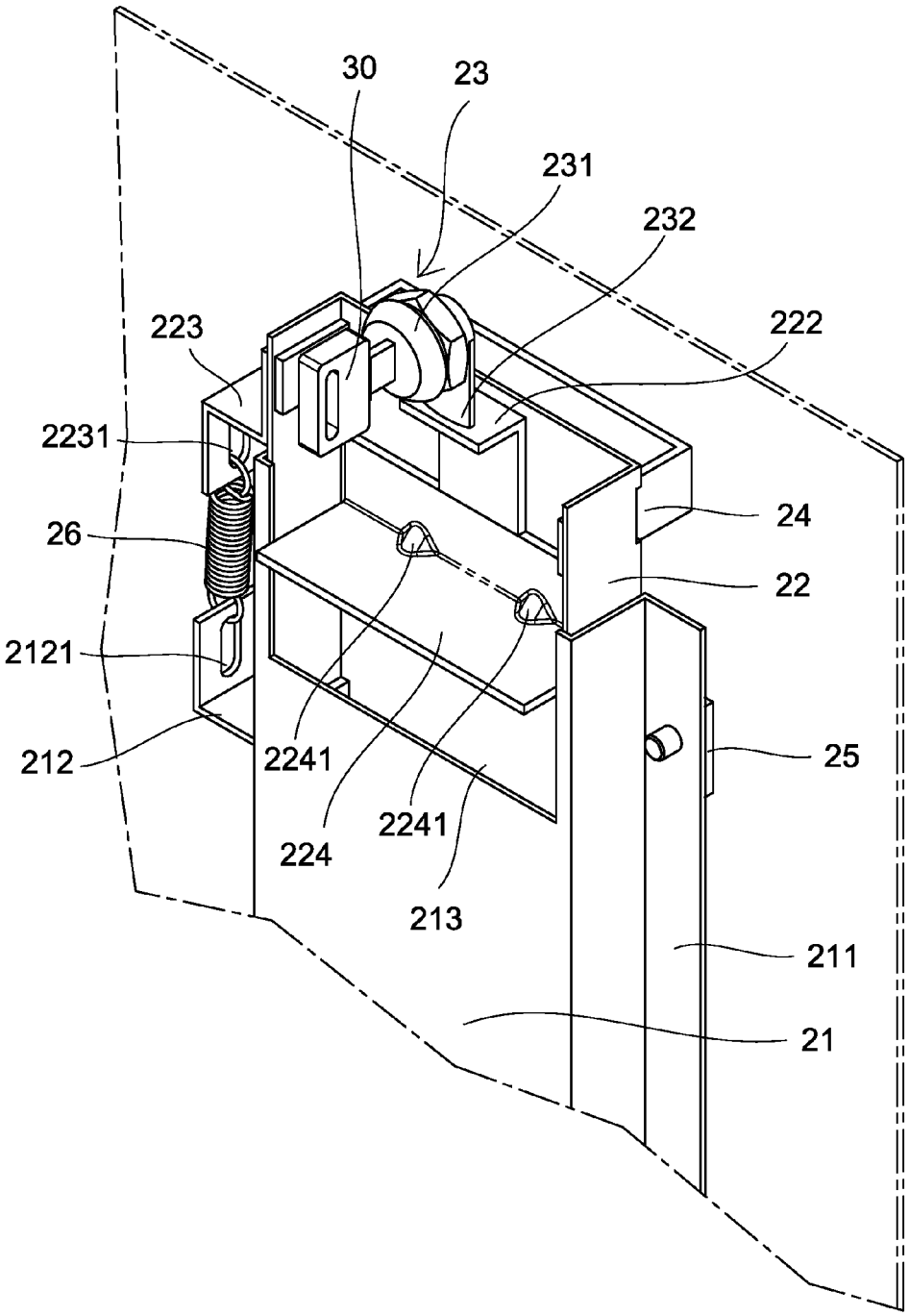
FIG. 5 is an enlarged view of the upper portion of FIG. 4.
Figure 6:
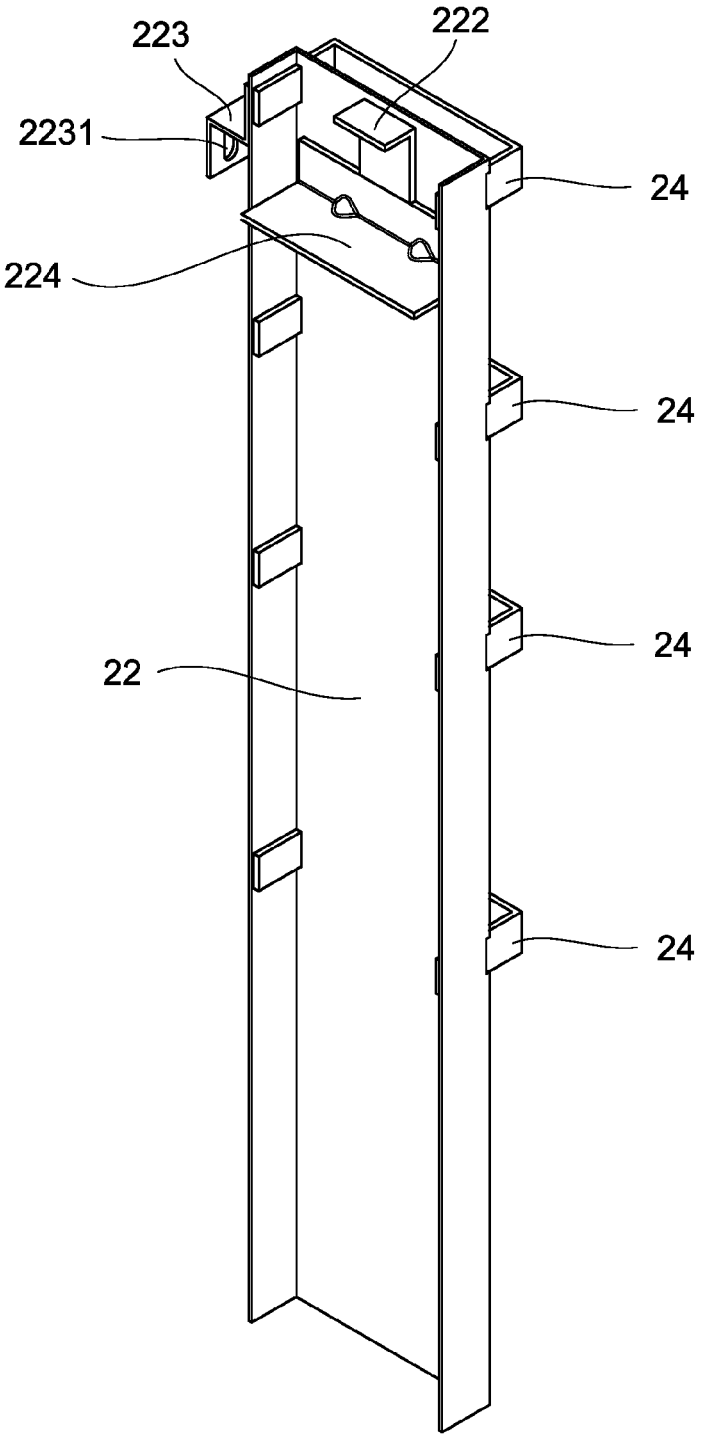
FIG. 6 is a perspective view of the sliding member.
Figure 7:
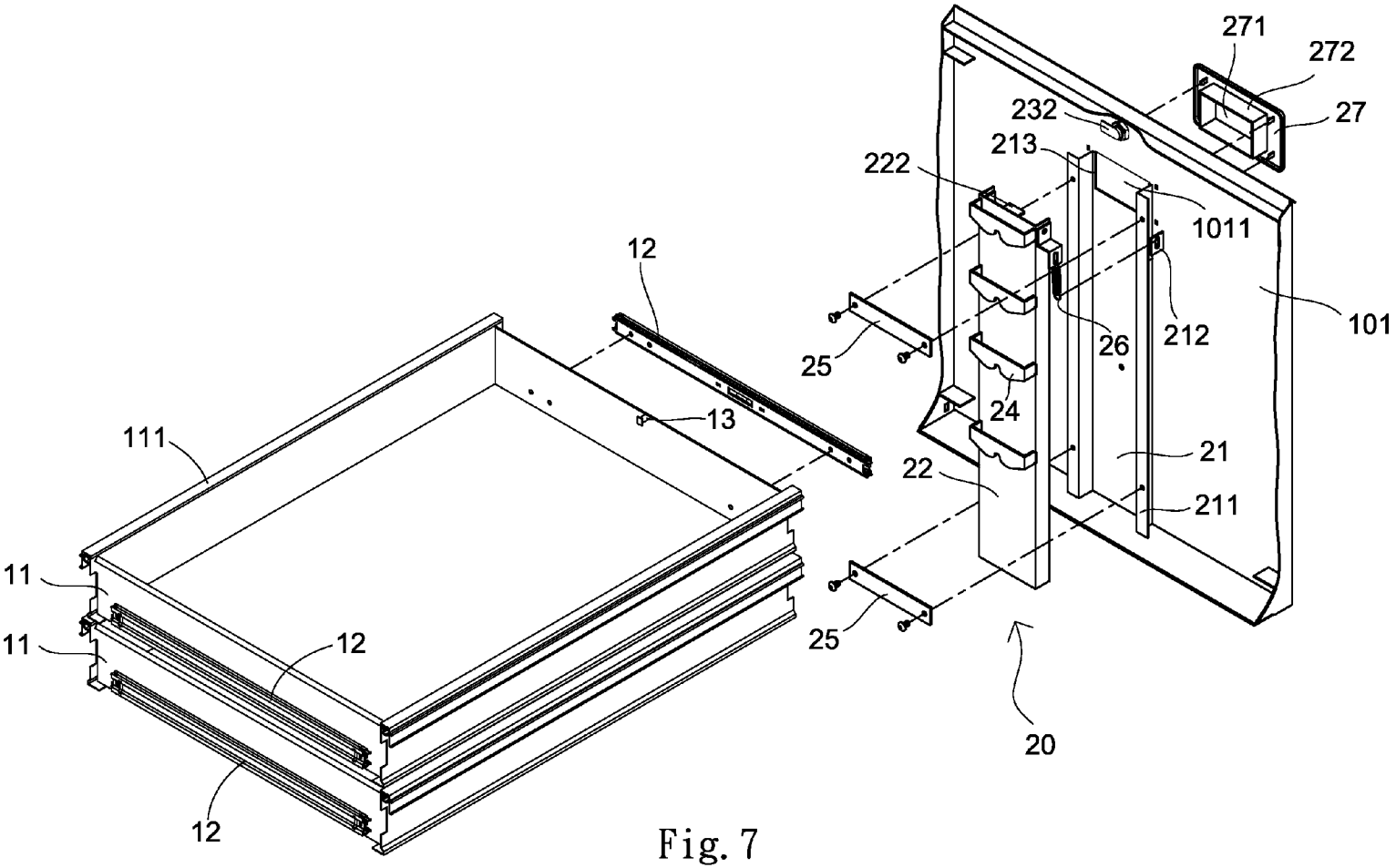
FIG. 7 is an exploded view of a side of the cabinet, a drawer, and the locking device.
Figure 8:
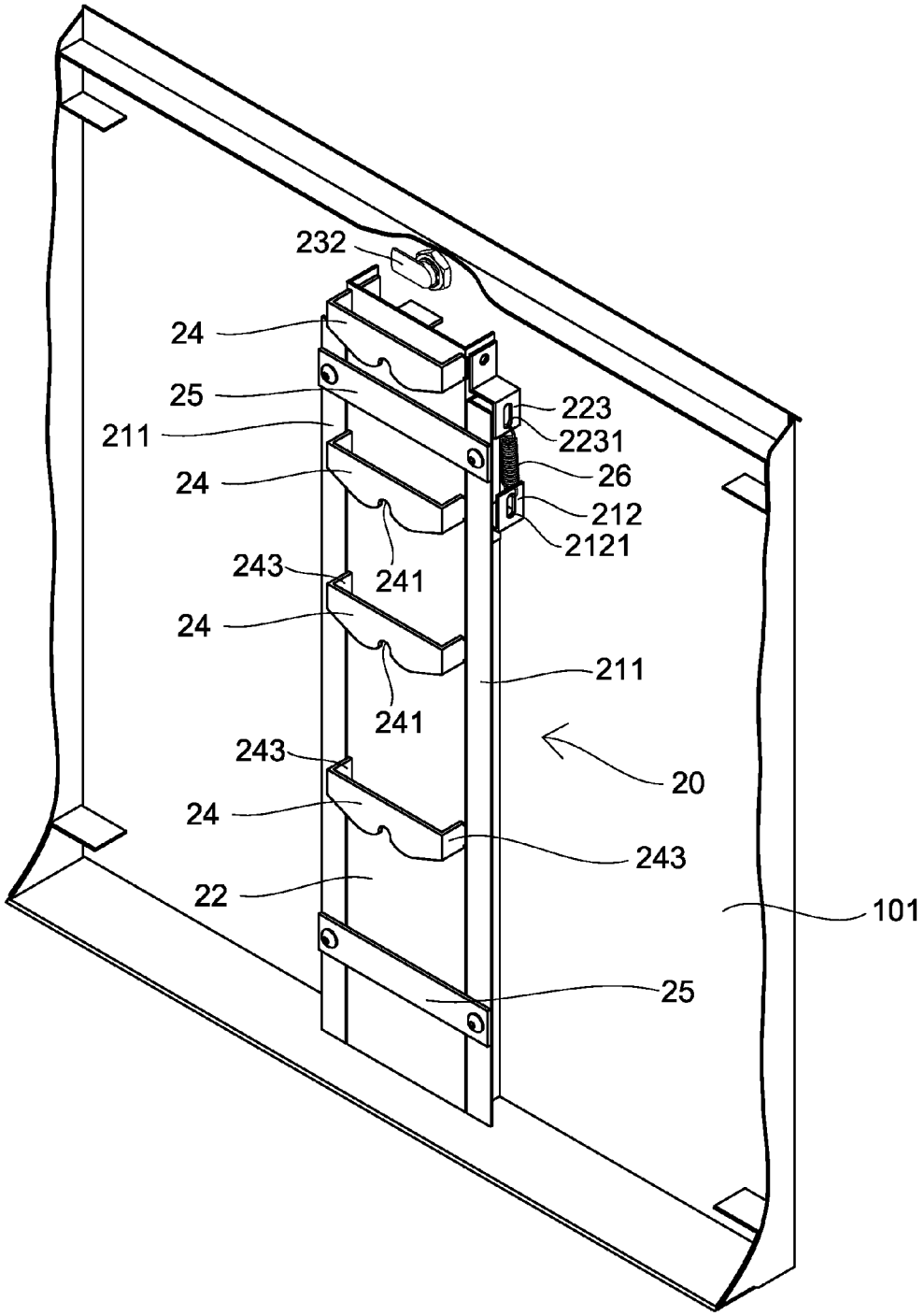
FIG. 8 is a perspective view of the side of the cabinet and the locking device being assembled.
Figure 9:
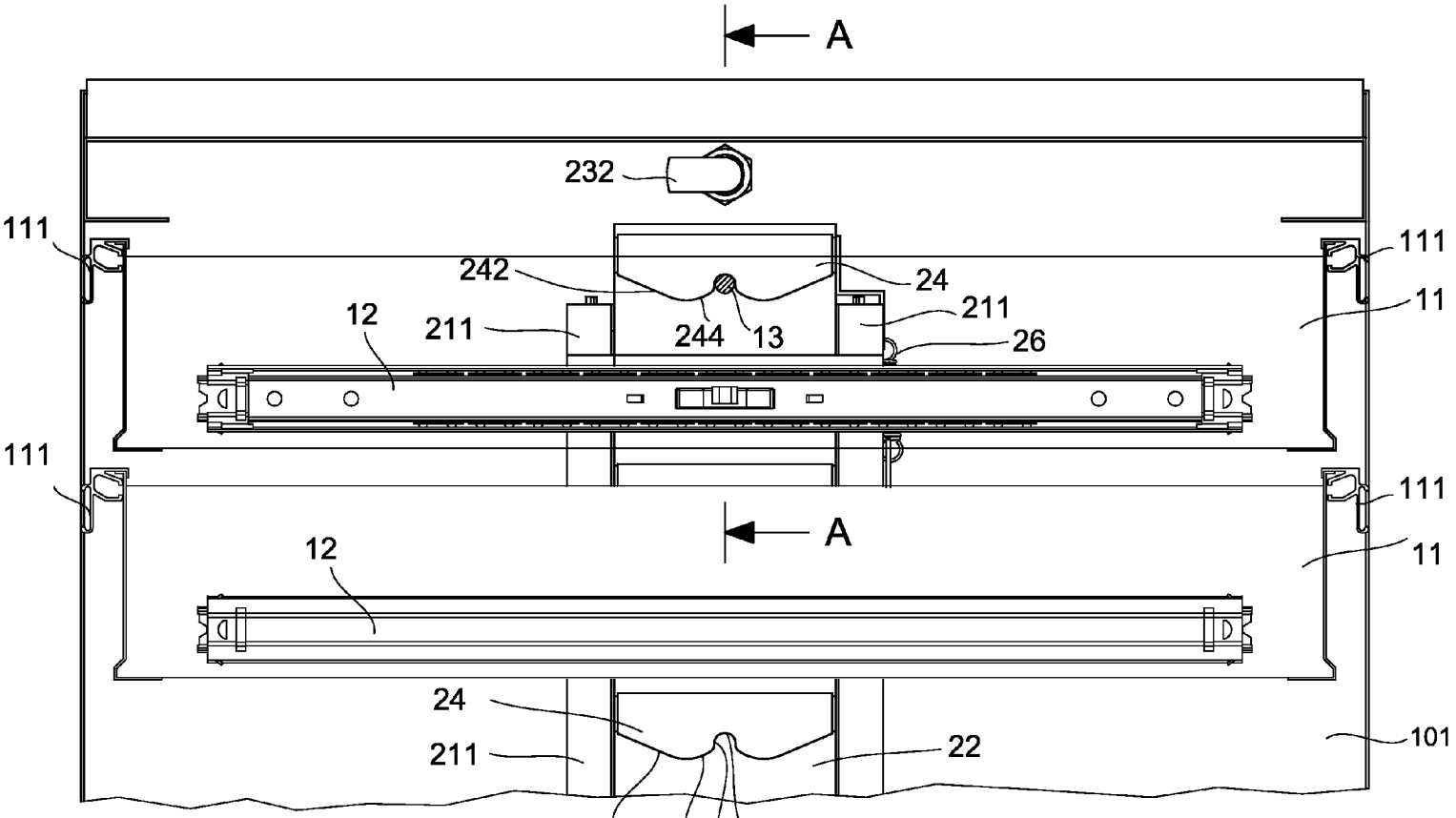
FIG. 9 is a side elevation showing the drawer being positioned by disposing the peg in the snapping member but not locked.
Figure 10:
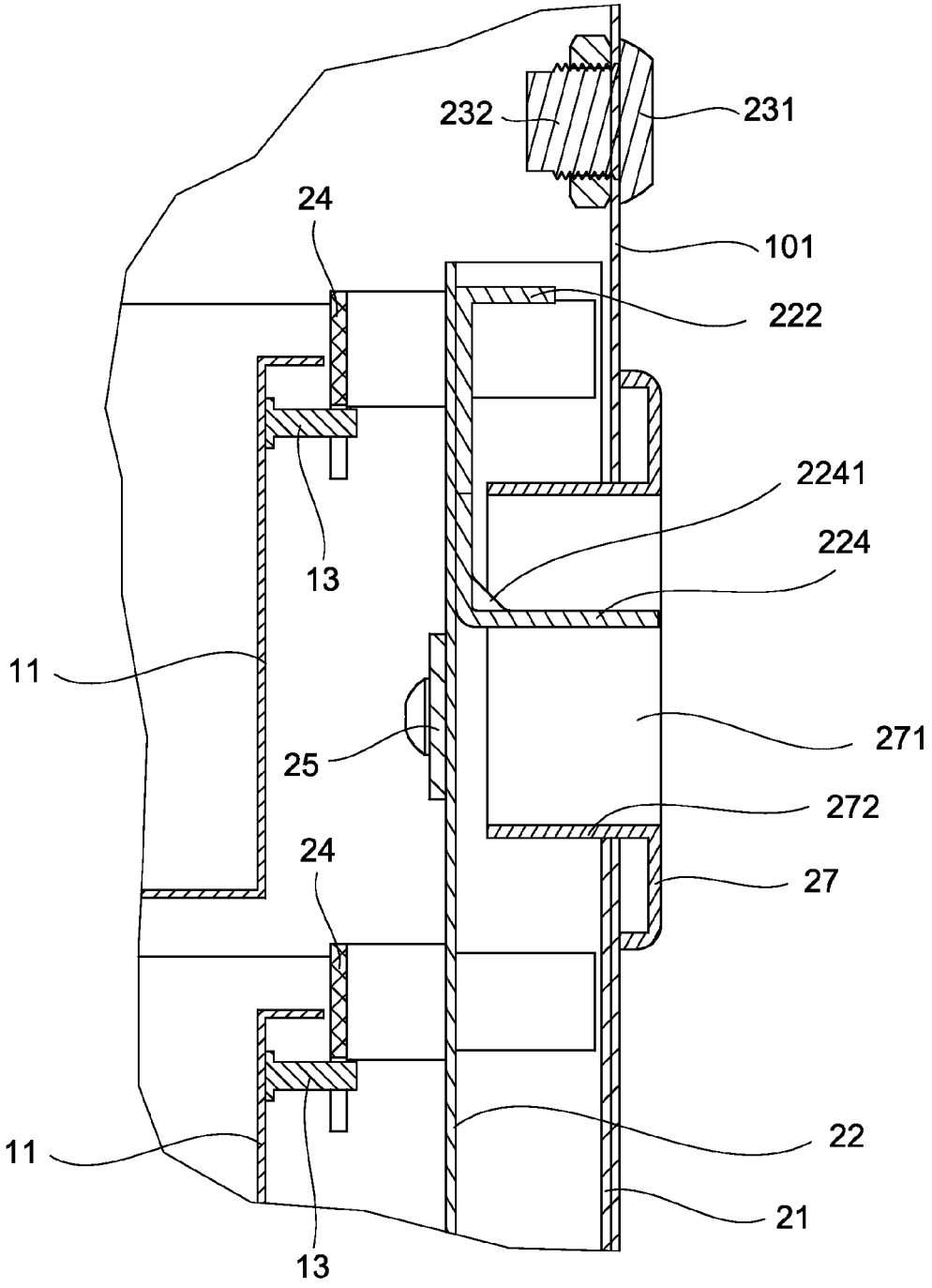
FIG. 10 is a sectional view taken along line A-A of FIG. 9.
Figure 11:
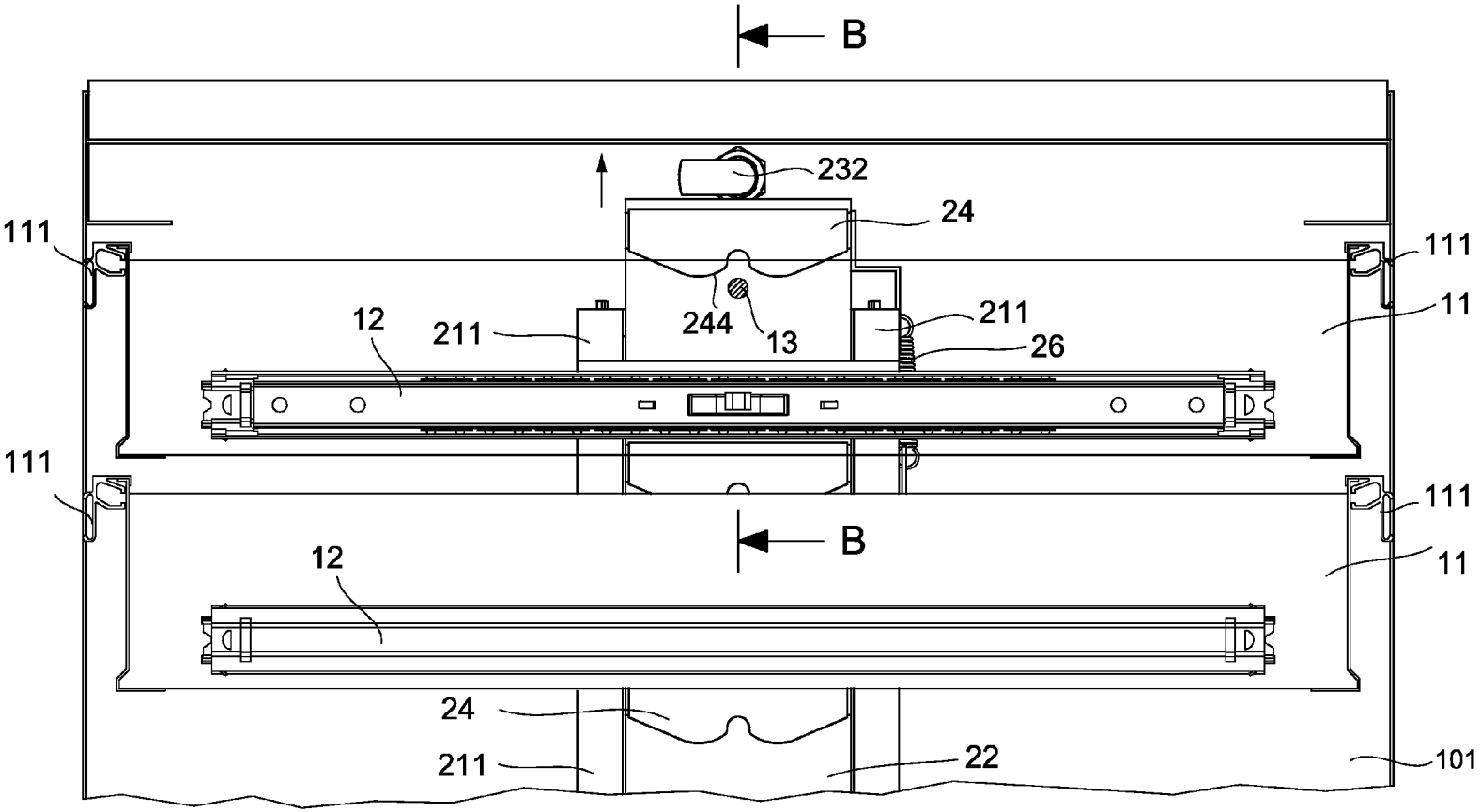
FIG. 11 is a view similar to FIG. 9 showing the drawer being free to push or pull after being not positioned and unlocked.
Figure 12:
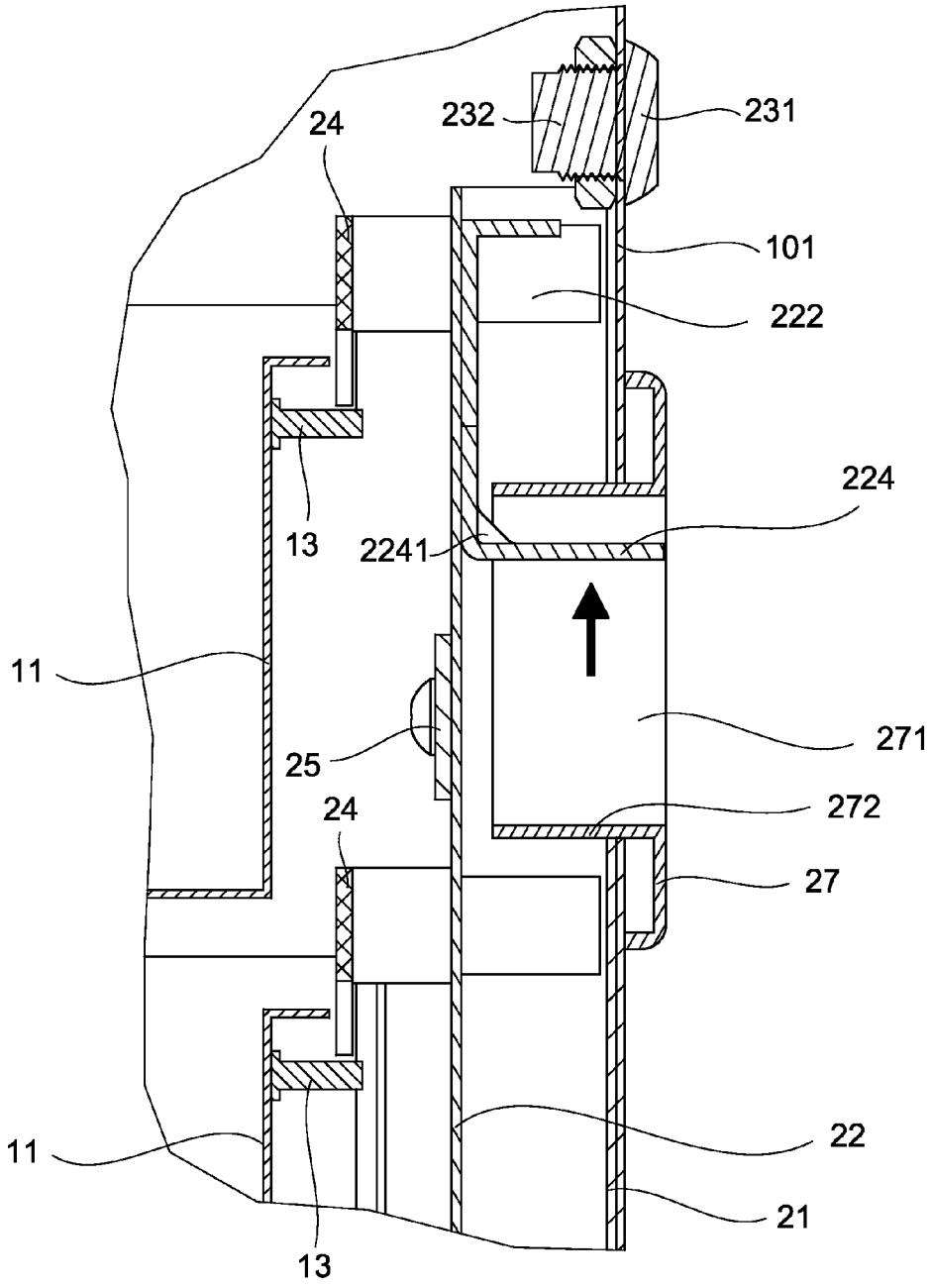
FIG. 12 is a sectional view taken along line B-B of FIG. 11.

Referring to FIGS. 1 to 12, a locking device 20 mounted on one side 101 of two opposite sides 101, 102 of a parallelepiped cabinet 10 and adapted to lock a plurality of two-way travel drawers 11 in accordance with the invention is shown. The cabinet further includes a top board 103 and a bottom board 104.

A rectangular first opening element 1011 is formed on the side. The spaced drawers 11 are arranged vertically in the cabinet 10. A peg 13 is provided on a central portion of one side of each drawer 11. A slide (e.g., two-way travel slide) 12 is lengthwise provided on an outer surface of each side of the drawer 11 for facilitating pulling or pushing operation either from a front end of the drawer 11 by holding a front handle 111 or from a rear end of the drawer 11 by holding a rear handle 111.

The locking device 20 comprises a longitudinal groove member 21, a sliding member 22, a lock 23, a plurality of snapping members 24, and a cover 27. The groove member 21 has a rectangular section, is secured to an intermediate portion of one side 101, and comprises front and rear flanges 211, a rectangular second opening element 213 on a top, and a first ear member 212 on an upper portion of the front flange 211, the first ear member 212 having an first through hole 2121.

The sliding member 22 has a section of rectangle and is shaped to slidably dispose in the groove member 21. Upper and lower rectangular plate members 25 are threadedly secured to the flanges 211 to limit the sliding member 22 to slide between an upper limit and a lower limit in the groove member 21. The sliding member 22 comprises a bent stop member 222 on a top of an outer surface, and a rectangular, horizontal trigger 224 moveably disposed in the second opening element 213 and under the stop member 222, the trigger 224 having two raised portions 2241 as enhancement. A second ear member 223 is formed on a top of the sliding member 22, the second ear member 223 having an second through hole 2231.

A torsion spring 26 has one end secured to the first through hole 2121 of the first ear member 212 and the second through hole 2231 of the second ear member 223 so that the sliding member 22 may slidably move in the groove member 21. The lock 23 comprises a key hole member 231 rotatably mounted on the side 101 and a latch member 232 perpendicular to and threadedly secured to the key hole member 231. The latch member 232 is disposed about parallel to the top of the stop member 222 in an unlocked position of the lock 23. A key 30 can be inserted into the key hole member 231 to counterclockwise rotate the latch member 232 until the latch member 232 urges against the top of the stop member 222, thereby limiting an upward movement of the sliding member 22 (i.e., the sliding member 22 being locked).

The snapping members 24 are provided vertically on an inner surface of the sliding member 22. The snapping member 24 comprises two end latches 243, an intermediate trough 241 having two vertical sides 2411 and a central concave portion 2412 interconnecting the vertical sides 2411, two first inclined surfaces 242 each extending from either end latch 243 toward the trough 241, and two second inclined surfaces 244 each interconnecting the adjacent first inclined surface 242 and the adjacent vertical side 2411. The end latch 243 is retained in an opening (not numbered) (see FIG. 8).

The rectangular cover 27 comprises a central third opening element 271 with the trigger 224 disposed therein, the third opening element 271 being aligned with both the first opening element 1011 and the second opening element 213 and passing through, and a closed flange 272 formed on an inner surface of the cover 27 and around the edge of the third opening element 271. The flange 272 is supported by both the side 101 and the groove member 21.

As shown in FIGS. 9 to 12 specifically, locking and unlocking operations of the invention are detailed below. The peg 13 is disposed in the trough 241. Thus, the drawer 11 is positioned but not locked (see FIG. 9). For opening the drawer 11, a user may push the trigger 224 upward and in turn, both the sliding member 22 and the snapping member 24 move upward. The peg 13 clears the trough 241. Thus, the drawer 11 is free to be pushed or pulled (see FIG. 11).

In case of one drawer 11 being not pushed into position and not locked by the lock 23, the user may push the drawer 11 to ride the peg 13 along the first and second inclined surfaces 242, 244 with both the snapping member 24 and the sliding member 22 moving upward. The upward movement may abruptly stops when the peg 13 is disposed directly below the trough 241. Thereafter, both the snapping member 24 and the sliding member 22 move downward immediately due to no support from below and their weight. The peg 13 disposes in the central concave portion 2412 of the trough 241 by passing through a space defined between the vertical sides 2411. As a result, the drawer 11 is positioned.

It is envisaged by the invention that the provision of the first inclined surfaces 242, the second inclined surfaces 244, and the vertical sides 2411 facilitates the correct positioning of the peg 13 in the trough 241.

While the invention has been described in terms of preferred embodiments, those skilled in the art will recognize that the invention can be practiced with modifications within the spirit and scope of the appended claims.

What is claimed is:

1. A locking device for a plurality of two-way travel drawers of a support body having a top board, a bottom board, and two opposite sides wherein one side has a first opening element, comprising in combination:

a peg disposed on one side of each of the two-way travel drawers;

two two-way travel slides each disposed on an outer surface of either side of each of the two-way travel drawers;

a groove member having a rectangular section and including front and rear flanges and a second opening element;

a sliding member having a rectangular section and slidably disposed in the groove member, the sliding member including a horizontal trigger moveably disposed in the second opening element;

a plurality of snapping members disposed vertically on an inner surface of the sliding member, each of the snapping members including two end latches secured to the sliding member, an intermediate trough having two vertical sides and a central concave portion interconnecting the vertical sides, two first inclined surfaces each extending from either end latch toward the trough, and two second inclined surfaces each interconnecting an adjacent first inclined surface and an adjacent vertical side;

a first ear member disposed on the front flange of the groove member, the first ear member having a first through hole;

a second ear member disposed on the sliding member, the second ear member being disposed under the first ear member and having a second through hole;

a biasing member having a first end secured to the first through hole of the first ear member and a second end secured to the second through hole of the second ear member so that the sliding member is configured to slidably move in the groove member;

a bent stop member disposed on a top of an outer surface of the sliding member;

a lock including a key hole member rotatably mounted on the one side of the support body, and a latch member being perpendicular to and threadedly secured to the key hole member, the latch member being disposed about parallel to a top of the stop member in an unlocked position of the lock, wherein a key is configured to insert into the key hole member to counterclockwise rotate the latch member until the latch member urges against the top of the stop member, thereby locking the sliding member;

upper and lower plate members threadedly secured to the flanges of the groove member for limiting the sliding member to slide between an upper limit and a lower limit in the groove member; and a cover including a third opening element with the trigger disposed therein, the third opening element being aligned with both the first opening element and the second opening element and passing through, and a closed flange formed on an inner surface of the cover and around an edge of the third opening element, the flange being supported by the one side of the support body and the groove member so that the trigger is configured to operate to move the sliding member either upward or downward;

wherein each of the two-way travel drawers is held in place when the peg is disposed in the trough;

wherein in response to pushing the trigger upward, the sliding member and one of the snapping members move upward so that the peg clears the trough to allow a free movement of each of the two-way travel drawers; and wherein in case of one of the two-way travel drawers being not pushed into position, a pushing of the one of the two-way travel drawers is configured to ride the peg along the first and second inclined surfaces with the one of the snapping members and the sliding member moving upward, the upward movement is configured to stop when the peg is disposed directly below the trough, and the one of the snapping members and the sliding member are configured to move downward to dispose the peg in the central concave portion of the trough by passing the vertical sides.

* * * * *